US011085234B2

(12) United States Patent
Hunt

(10) Patent No.: US 11,085,234 B2
(45) Date of Patent: Aug. 10, 2021

(54) SECURE IN-DOOR PARCEL RECEIVING APPARATUS

(71) Applicant: Morris Hunt, Guelph (CA)

(72) Inventor: Morris Hunt, Guelph (CA)

( * ) Notice: Subject to any disclaimer, the term of this patent is extended or adjusted under 35 U.S.C. 154(b) by 0 days.

(21) Appl. No.: 17/026,153

(22) Filed: Sep. 18, 2020

(65) Prior Publication Data

US 2021/0079720 A1 Mar. 18, 2021

Related U.S. Application Data

(60) Provisional application No. 62/902,193, filed on Sep. 18, 2019.

(51) Int. Cl.

| | |
|---|---|
| ***E06B 7/32*** | (2006.01) |
| ***E06B 7/28*** | (2006.01) |
| ***A47G 29/12*** | (2006.01) |
| ***A47G 29/14*** | (2006.01) |
| ***A47G 29/124*** | (2006.01) |
| *E05B 65/00* | (2006.01) |
| *E05B 37/00* | (2006.01) |

(52) U.S. Cl.

CPC ..... *E06B 7/32* (2013.01); *A47G 29/12* (2013.01); *A47G 29/124* (2013.01); *A47G 29/14* (2013.01); *E06B 7/28* (2013.01); *A47G 2029/1257* (2017.08); *E05B 37/0072* (2013.01); *E05B 65/00* (2013.01)

(58) Field of Classification Search

CPC .. E06B 7/32; E06B 7/28; A47G 29/12; A47G 29/124; A47G 29/14; A47G 29/141; A47G 29/22; A47G 2029/1257; E05B 37/0072; E05B 65/00

USPC ..... 232/19, 44, 45, 43.5; 49/142; 109/66; 193/8

See application file for complete search history.

(56) References Cited

U.S. PATENT DOCUMENTS

| | | | | |
|---|---|---|---|---|
| 5,368,226 | A * | 11/1994 | Franceschino ..... | A47G 29/1223 232/19 |
| 5,492,272 | A * | 2/1996 | Fewer ..... | A47G 29/12 232/19 |
| 10,413,106 | B1 * | 9/2019 | Valeriano ..... | E06B 7/32 |
| 10,512,351 | B1 * | 12/2019 | Valeriano ..... | E05B 47/0001 |
| 10,588,440 | B1 * | 3/2020 | Kajgana ..... | A47G 29/28 |
| 10,878,647 | B2 * | 12/2020 | Kane ..... | A47G 29/141 |
| 10,881,233 | B1 * | 1/2021 | Walsh ..... | E06B 7/28 |
| 2004/0084276 | A1 * | 5/2004 | Repic ..... | B65G 11/20 193/34 |

(Continued)

*Primary Examiner* — William L Miller

(57) ABSTRACT

A secure in-door parcel receiving apparatus may be installed into an aperture of a barrier such as a garage door in order to receive delivered parcels to the interior of a residence or other location so as to avoid package theft and environmental hazards parcels may be exposed to if left outdoors when delivered. An interior frame is connected to an inside of the barrier within the barrier aperture. An exterior frame is connected to the interior frame and supports a hinged closure. A locking mechanism releasably secures the closure in a closed position, occluding the aperture, until a parcel is to be delivered, whereupon a parcel delivery worker may provide input to a user interface, such as a combination lock, of the locking mechanism in order to disengage the locking mechanism, open the closure, and deliver the parcel through the aperture into the interior location behind the barrier.

12 Claims, 5 Drawing Sheets

(56) References Cited

U.S. PATENT DOCUMENTS

| | | | | |
|---|---|---|---|---|
| 2017/0143146 | A1* | 5/2017 | Charbeneau | A47G 29/141 |
| 2018/0199745 | A1* | 7/2018 | Charbeneau | A47G 29/22 |
| 2018/0317687 | A1* | 11/2018 | Crooks | A47G 29/22 |
| 2019/0282015 | A1* | 9/2019 | High | A47G 29/141 |
| 2020/0035051 | A1* | 1/2020 | Kane | G07C 9/00896 |

* cited by examiner

SECURE IN-DOOR PARCEL RECEIVING APPARATUS

The current application claims a priority to the U.S. Provisional Patent application Ser. No. 62/902,193 filed on Sep. 18, 2019.

FIELD OF THE INVENTION

The present invention relates generally to a parcel receiving apparatus. More specifically, the present invention relates to an apparatus that enables packages to be delivered to unattended locations by delivery personnel.

BACKGROUND OF THE INVENTION

In our modern era, there is high demand for a delivery receiving system in unattended locations. The delivery process for parcels in the United States allows parcels to be left on the porch of properties, often in an insecure place, where the delivery can simply be taken by a thief. With e-commerce growing in convenience and utilization, so is the idea of "porch theft" (pirates). In the recent past, kids left their bicycles on the front lawn, visited with friends, and returned to their bikes to find them untouched. Unfortunately, today, things are very different: People absolutely must lock cars, bikes, homes, and other property.

With the anticipated rapid growth in Internet commerce, a corresponding increase in the delivery of packages by delivery personnel is projected. However, with the rising number of people away from their residences during the day, it is increasingly difficult for delivery personnel to make contact with the intended recipients to complete deliveries. Consequently, delivery personnel are often compelled to leave packages on a porch or protruding from a mailbox or door or attempt to locate a neighbor willing to sign for the package; otherwise, delivery personnel must return packages to a distribution center, attempt to make contact with the intended recipients, and deliver them at a later time. When packages are not secured at the point of delivery, they are subject to theft, pilferage, spoilage, damage, and/or destruction resulting from adverse environmental conditions. Apparatuses for receiving packages that do not involve a person at the receiving location exist. However, currently available devices typically have substantial hardware requirements and an expensive and complex configuration, making the devices difficult to install.

There is a need for a package receiving device that is easy to install, is lightweight, and provides security. Thus, improvements are needed to the parcel receiving device. The present invention aims to solve the aforementioned problems by improving a conventional parcel receiving device through innovative construction to provide easy installation and protection for delivered parcels without sacrificing visual appeal.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention provides a package receiving device that is lockable and can easily be installed into an existing garage door. A user of the present invention can put a personal identification number (PIN) or another type of identifier code in the special delivery instructions to give the shipping company or delivery person access to open the door provided by the present invention and place the package inside the garage or a home entrance. The door of the present invention can be locked when the door is closed after the delivery parcel is placed inside through the door opening, keeping the delivered parcel safe and secure from theft. The present invention may be installed in the existing garage door but does not interfere with its function or integrity. The configuration of the present invention also allows the users to paint the present invention any desired color. The present invention can be manufactured in a variety of sizes to accommodate different sized parcels.

Figure 1:
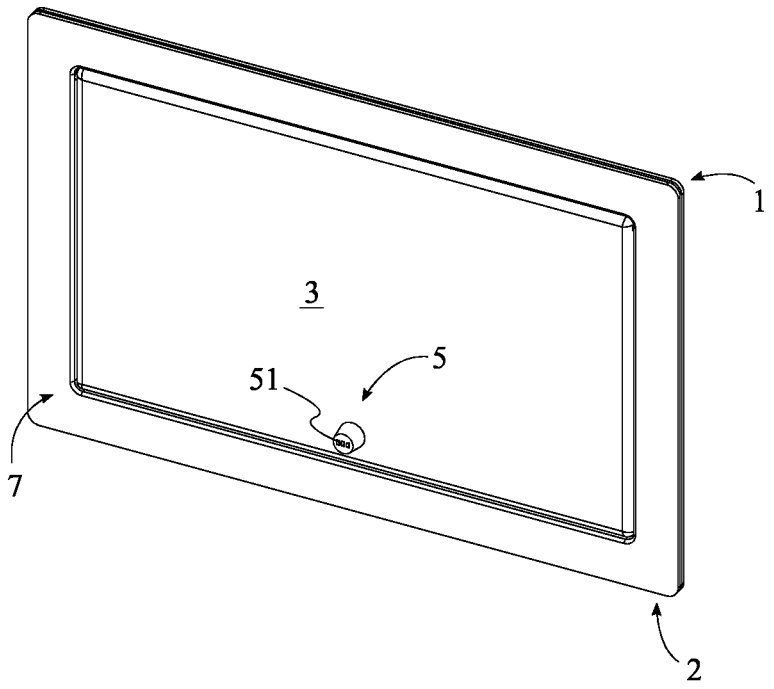
FIG. 1 is a perspective view of the present invention with the closure in a closed position.
Figure 2:
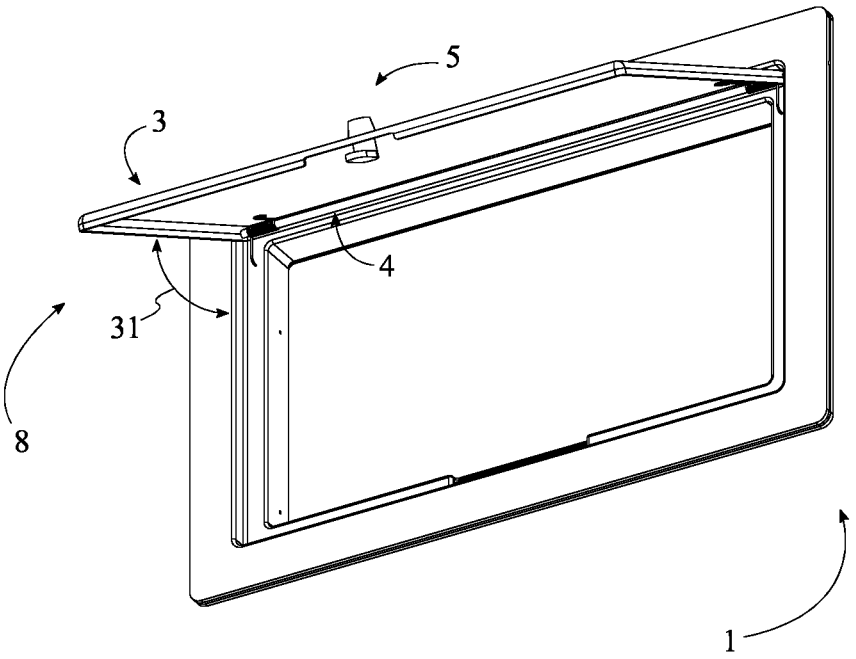
FIG. 2 is a perspective view of the present invention with the closure in an opened position.
Figure 3:
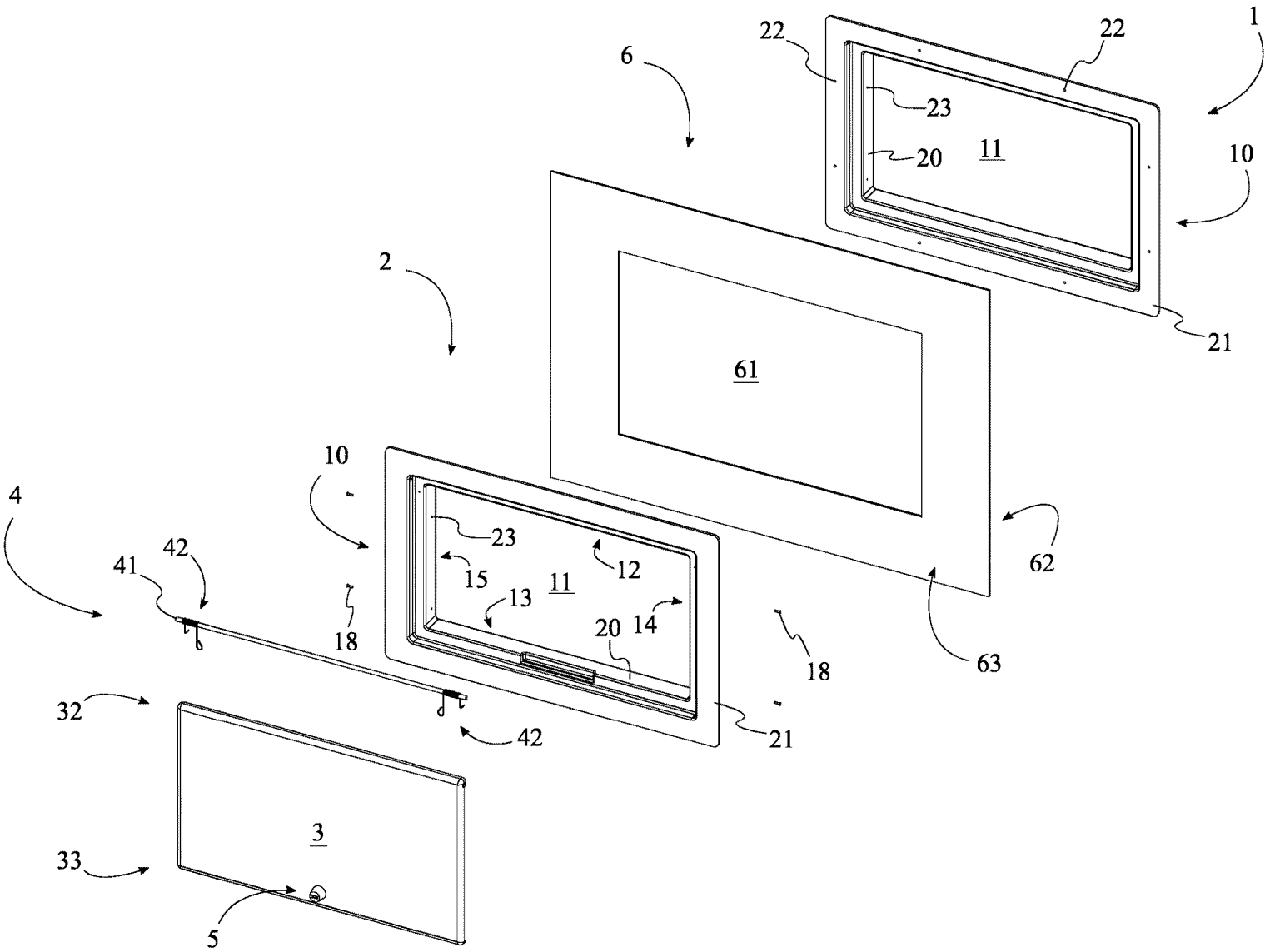
FIG. 3 is a perspective exploded view of the present invention.

In general, referring to FIGS. 1-3, the present invention comprises an interior frame 1, an exterior frame 2, a closure 3, a hinge 4, and a locking mechanism 5. The interior frame 1 and the exterior frame 2 are structural members of the present invention which facilitate installation of the present invention into a garage door or other barrier 6, such as a residential front door. In order to install the present invention into a barrier 6, the barrier 6 must comprise an aperture 61. To this end, to install the present invention in an existing garage door, for instance, a user may be required to cut an aperture 61 out of their existing garage door. Alternatively, a garage door may be manufactured with a pre-existing aperture 61 or with the present invention already installed. The internal frame is connected to the inside of the garage door, and the external frame is connected to the internal frame adjacent to the outside of the garage door, and the two frames are connected together toward the inside of the garage door in order to not expose any fasteners to would-be thieves for easy disassembly. The frames of the present invention may be connected together with any suitable type of fasteners, such as, but not limited to, screws (e.g., self-tapping screws), bolts, or other threaded fasteners.

The interior frame 1 and the exterior frame 2 each comprise a lateral body 10 and an aperture 11. The lateral body 10 delineates the aperture 11 for each of the interior frame 1 and the exterior frame 2, wherein the aperture 11 centrally traverses through the lateral body 10 for each of the interior frame 1 and the exterior frame 2. The interior frame 1 and the exterior frame 2 are connected adjacent to each other, wherein the interior frame 1 is configured to be mounted to an aperture 61 traversing through a barrier 6, such as, but not limited to, a garage door, adjacent to an interior side 62 of the barrier 6, and wherein the exterior frame 2 is configured to be mounted to the interior frame 1 adjacent to an exterior side 63 of the barrier 6. The aperture 11 of the interior frame 1 and the aperture 11 of the exterior frame 2 are positioned concentrically with each other. When a delivery person utilizes the present invention to securely deliver a parcel, the delivery person opens the closure 3 and passes the parcel through the apertures of the exterior frame 2, interior frame 1, and barrier 6, which generally coincide when the present invention is installed into the aperture 61 of the barrier 6.

The closure 3 is a door component of the present invention that controls access to and passage through the aperture 61 of the barrier 6. In the preferred embodiment of the present invention, the closure 3 is hingedly connected to the exterior frame 2 through the hinge 4, though it is contemplated that in various embodiments, various alternative specific mechanisms and/or geometric arrangements may be employed to enable the functionality of a closure 3 over the aperture 61 of the barrier 6, such as, but not limited to, a sliding door mechanism. The closure 3 is releasably fastened in a closed position 7 over the aperture 11 of the exterior frame 2 through the locking mechanism 5, wherein the aperture 11 of the exterior frame 2 is occluded by the closure 3 in the closed position 7.

In the preferred embodiment, the locking mechanism 5 comprises a user interface. The user interface is operatively connected to the locking mechanism 5, wherein the user interface is configured to disengage the locking mechanism 5 if valid user input is received through the user interface. In some embodiments, the user interface of the locking mechanism 5 comprises a combination lock, such as, but not limited to, a single dial lock or a multiple dial lock. In some embodiments, the user interface of the locking mechanism 5 may comprise a more advanced user interface such as an electronic keypad. In any case, the user interface should enable a parcel delivery person to disengage the locking mechanism 5 using information such as a lock combination or PIN that the person placing the online order may add to the delivery instructions in order to allow the parcel delivery person to utilize the present invention to securely deliver a parcel to the interior of the recipient's garage or other location.

As previously mentioned, in the preferred embodiment, the interior frame 1 is configured to be mounted to an aperture 61 traversing through a garage door adjacent to an interior side 62 of the garage door, and the exterior frame 2 is configured to be mounted adjacent to an exterior side 63 of the garage door.

Though it is contemplated that in various embodiments, the present invention may have various geometries, in the preferred embodiment of the present invention, the interior frame 1 and the exterior frame 2 have generally rectangular geometry. Thus, the interior frame 1 and the exterior frame 2 each comprise a top side 12, a bottom side 13, a first lateral side 14, and a second lateral side 15, with the top side 12 and the bottom side 13 being terminally connected between the first lateral side 14 and the second lateral side 15 and positioned opposite each other along the first lateral side 14 and the second lateral side 15.

Furthermore, in the preferred embodiment, the lateral body 10 of the interior frame 1 and the exterior frame 2 each comprise a frame attachment body 20 and a flange 21. The frame attachment body 20 and the flange 21 are perimetrically and perpendicularly connected to each other for each of the interior frame 1 and the exterior frame 2, and the frame attachment body 20 of the exterior frame 2 is positioned perimetrically adjacent to and within the frame attachment body 20 of the interior frame 1. The flange 21 of the interior frame 1 is configured to be connected around the aperture 61 of the barrier 6. To this end, in some embodiments, the flange 21 of the interior frame 1 comprises a plurality of barrier mounting holes 22, with the plurality of barrier mounting holes 22 traversing through the flange 21 of the interior frame 1, wherein the flange 21 of the interior frame 1 is configured to be mounted to the barrier 6 through the plurality of barrier mounting holes 22 and a plurality of barrier mounting fasteners.

Moreover, in some embodiments, the present invention comprises a plurality of frame fasteners 18, while the frame attachment body 20 of the interior frame 1 and the frame attachment body 20 of the exterior frame 2 each comprise a plurality of frame mounting holes 23. The plurality of frame mounting holes 23 of the interior frame 1 are aligned with the plurality of frame mounting holes 23 of the exterior frame 2. Each of the plurality of frame fasteners 18 traverses through one of the plurality of frame mounting holes 23 of the interior frame 1 and one of the frame mounting holes 23 of the exterior frame 2, wherein the frame attachment body 20 of the exterior frame 2 is mounted to the frame attachment body 20 of the interior frame 1 through the plurality of frame fasteners 18.

In the preferred embodiment of the present invention, the hinge 4 is a spring-loaded hinge 4 configured to support the closure 3 in a partially open position 8, wherein the closure 3 is positioned at a desired angle 31 to the exterior frame 2 in the partially open position 8. This feature serves to aid a parcel delivery worker in the process of delivering a parcel through the present invention, since otherwise it may be difficult for them to lift the closure 3 and place the parcel through the aperture 61 simultaneously.

More particularly, in the preferred embodiment, the hinge 4 comprises a rod 41. The rod 41 is laterally connected between the first lateral side 14 and the second lateral side 15 of the external frame adjacent to the upper side of the external frame. The closure 3 is terminally and rotatably connected to the rod 41, such that the closure 3 rotates about the rod 41 adjacent to the upper side of the external frame.

Furthermore, the hinge 4 comprises at least one spring. More particularly, in the preferred embodiment, the hinge 4 comprises a plurality of springs 42, by a count of at least two springs. Each of the plurality of springs 42 is operatively connected between the exterior frame 2 and the closure 3, wherein the plurality of springs 42 is configured to support the closure 3 in the partially open position 8. Moreover, in some embodiments, each of the plurality of springs 42 is positioned around the rod 41 of the hinge 4.

The closure 3 comprises a proximal end 32 and a distal end 33. The proximal end 32 of the closure 3 is rotatably connected to the external frame through the hinge 4. More particularly, the proximal end 32 of the closure 3 is rotatably connected to the rod 41 of the hinge 4. The locking mechanism 5 is connected to the distal end 33 of the closure 3, and the locking mechanism 5 is configured to releasably engage with the bottom end of the external frame when the closure 3 is in the closed position 7.

Figure 4:
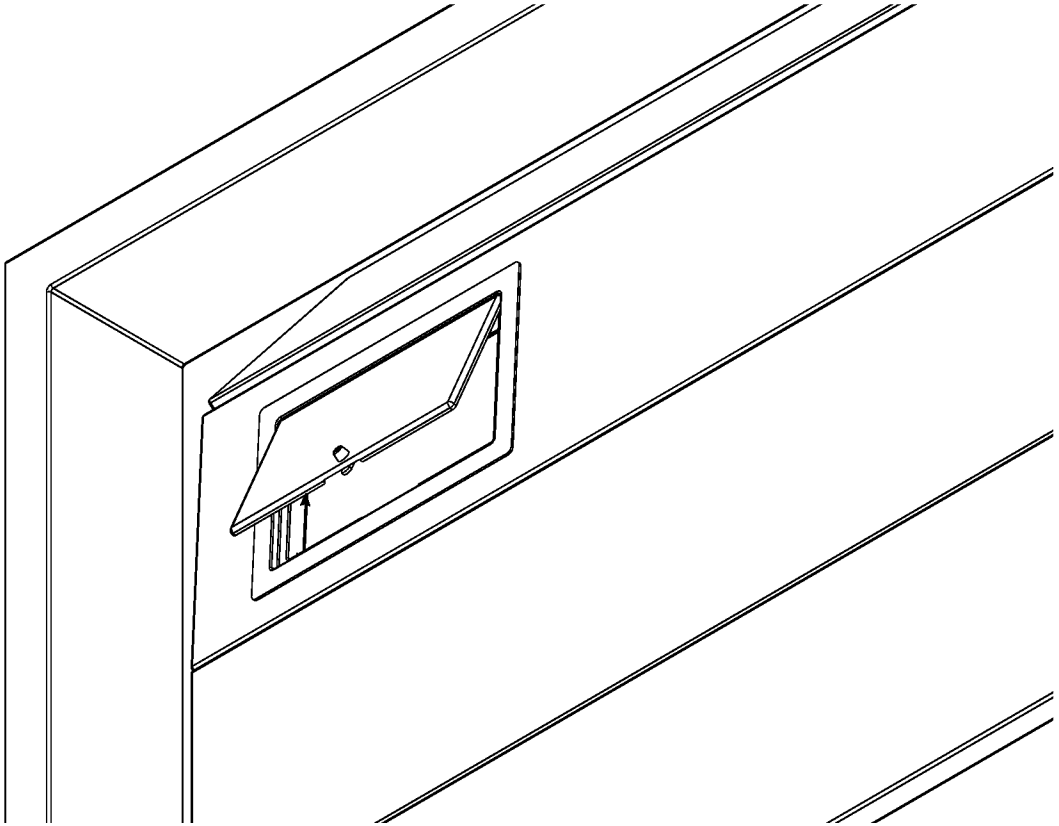
FIG. 4 is an illustration of the present invention installed into a garage door with the closure in the opened position.
Figure 5:
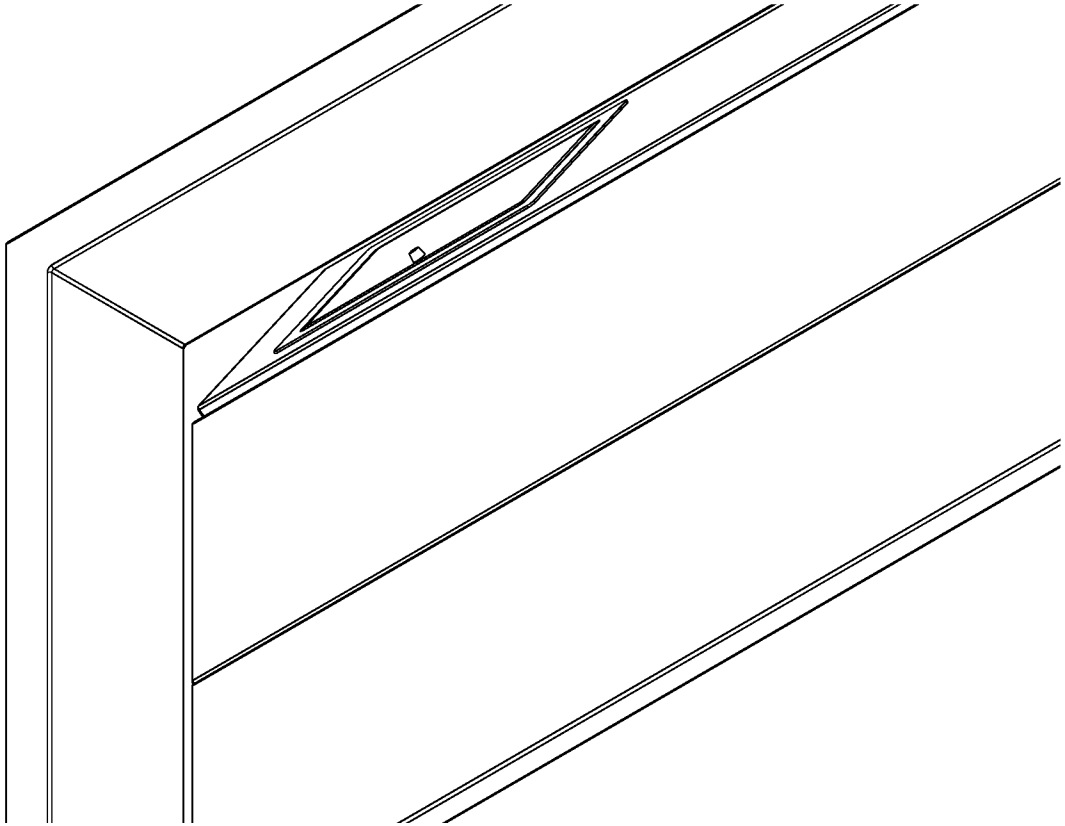
FIG. 5 is an illustration subsequent to FIG. 4 showing the closure having been displaced into the closed position by its own weight as the garage door is opened.

It may be further noted as an ancillary benefit of the present invention in some embodiments that when the present invention is installed into a garage door as the barrier 6, if the closure 3 is left in the opened position 8 by a parcel delivery worker, for example, as the garage door is opened, the closure 3 is displaced by its own weight into the closed position 7, as illustrated in FIGS. 4-5. This may be enabled in various embodiments by selecting the plurality of springs 42 to provide a maximum spring force less than the maximum weight of the closure 3 on the plurality of springs 42.

The following is an alternative, exemplary description of the present invention intended for further illustrate the spirit of the present invention, and should not be considered to be limiting.

The present invention provides a package receiving device that is lockable and can easily be installed into an existing garage door. A user of the present invention can put a personal identification number (PIN) in the special delivery instructions to give the shipping company or delivery person access to open the door provided by the present invention and place the package inside the garage or a home entrance. The door of the present invention can be locked when the door is closed after the delivery parcel is placed inside through the door opening, keeping the delivered parcel safe and secure from theft. The present invention may be installed in the existing garage door but does not interfere with its function or integrity. The configuration of the present invention also allows the users to paint the present invention any desired color. The present invention can be manufactured in a variety of sizes to accommodate different sized parcels.

The present invention provides a parcel receiving device comprising a door, an outside frame, inside frame, a door lock system, a door flap system, and a plurality of fasteners.

The door can be attached to the outside frame using the door flap system, and the door lock system can be positioned on the door to lock the door to the outside frame. The outside frame can be secured into a cutout area of a garage door using fasteners.

The inside frame can be connected to the outside frame with the fasteners through the cutout area of the garage door. The door, outside frame, and inside frame can take a rectangular shape or any other shape and can be installed via a cutout area in a suitable place on the garage door. The plurality of fasteners used in the present invention can include screws (e.g., self-tapping screws), bolts, or other threaded fasteners.

The door may comprise a body and a plurality of apertures. The body can include a generally planar rectangular body with a top edge, two side edges, and a bottom edge.

In one embodiment, the top edge of the door can be secured to the door flap system. The two side edges and the bottom edge of the door can be free to allow the door to swing in and out of the outside frame. The door can be affixed in a stationary straight down position by means of a lock provided on the bottom edge of the door. When in the closed position, the door can be aligned parallel to the exterior surface of the garage door on which the parcel receiving device is installed. The door can be made of a sheet of durable yet lightweight and flexible material such as plastic (e.g., acrylonitrile butadiene styrene (ABS) plastic), substantially filling the entire interior portion of the outside frame.

The outside frame may comprise a plurality of outside screw holes to connect the door to the door flap system. The outside frame may also comprise a strip of sealing material that can be applied to the edges of the outside frame to prevent unwanted air or water and the like from passing between the door and the outside frame.

Once the door and the outside frame are installed into the open cutout area in the garage door from the outside, the inside frame can be installed from the inside tightly against the outside frame to protect the parcel receiving device from weather elements.

The inside frame may comprise a plurality of inside screw holes. The inside frame can be of a corresponding size to the outside frame and placed into the cutout area of the garage door and fastened to the outside frame. In one example, the outside frame and the inside frame can be fitted together through the cutout area in the garage door and secured to each other using screws configured to fit through the inside screw and outside screw holes. The outside frame and the inside frame may have a geometric configuration that facilitates attachment therebetween.

The door lock system may comprise a combination lock or any mechanical lock that can be installed on the door to keep the door closed and locked. In one embodiment, the door lock system can further comprise a latch, such as a bar or lever, that can move between a locking and non-locking position. A latch in a locking position can prevent the door from being opened. In another embodiment, the door lock system may include a mechanical system to automatically lock a latch. For example, the door lock system can be configured to have a spring-actuated latch so the closure of the door returns the latch to a locking position. In one aspect, the door lock system can include a PIN. For example, the combination lock can be installed and secured via a PIN chosen by the user. A delivery person wishing to deliver a parcel to a specified address with a parcel receiving device would be given the PIN in advance as a part of the delivery instructions. After a PIN is entered, the door can be unlocked.

The door flap system may comprise a rod, a first spring, and a second spring. In one embodiment, the rod may provide the door with a pivotal connection to the outside frame with the first spring and the second spring pushing the door to an open position. In one example, for the pivotal connection, the door may include a first door hole and a second door hole. The outside frame may include a first outside hole and a second outside hole. The first spring can be placed on one end of the rod and turned to provide the tension required to open the door after installation. The second spring can be placed on the other side of the rod opposite the first spring attachment and turned to the required tension. When the proper amount of turns is completed on the first and second spring, the rod can connect the door and the outer frame. One end of the rod with the first spring may be fed through the first door hole in the door, and the first outside hole in the outside frame and the other end opposite the first spring attachment can be fed through the second door hole in the door and the second outside hole in the outside frame.

In one embodiment, the first spring and the second spring of the door flap system can be custom-made torsion springs, coil springs, or arm springs. The ends of the first spring and the second spring can be attached to the door and the outside frame to hold the first spring and the second spring in place.

For example, the door and outside frame can include pinholes where the ends of the first spring and the second spring can be put in and secured by an adhesive to hold the first and second spring in place. The door and the outside frame may further include any number of additional fastening holes adapted to fasten and hold the outside frame and door together. The rod can be made from metal or any suitable material for such a connection to the door and the outside frame.

In one embodiment, the spring force from the first spring and the second spring can cause the door to open at an angle sufficient (e.g., 1-2 inches) for a delivery person to grab the door and lift the door up and close the door after a parcel has passed through the opening provided by the open door. The opening provided from the fully opened door can be a suitable size but may not be of sufficient size for furniture, TV, and so forth, which may require fully opening the garage door. In operation, the door pivots relative to the garage door surface about the rod between a fully open and closed position. In the closed position, the door is parallel to the garage door surface. The door can be pivoted about a rod relative to the garage door to provide a sufficient opening for a package to pass through it, for example, between about 100 and 160 degrees from the closed position.

In one embodiment, the delivery person can type in the preset PIN to unlock the parcel receiving device. The delivery person may then lift up the door to open the parcel receiving device. The delivery person may then place a parcel through the opening provided by the door and return the parcel receiving device to its closed and locked position.

In one aspect, the parcel receiving device can be manufactured to facilitate easy installation. For example, the buyer can purchase a package of the parcel receiving device that includes an assembly of a door and an outside frame already attached and an inside frame that is separate from the assembly so that the buyer can install the parcel receiving device onto a garage door or any other door using fasteners. In another aspect, the present invention can easily be custom colorized. For example, the parcel receiving device can be manufactured and configured using lightweight material so the purchaser can take the parcel receiving device and a sample color for the garage door to a hardware or paint store to digitally match the color of the parcel receiving device and the garage door and paint the parcel receiving device the same color as the garage door color.

Although the invention has been explained in relation to its preferred embodiment, it is to be understood that many other possible modifications and variations can be made without departing from the spirit and scope of the invention as hereinafter claimed.

What is claimed is:

1. A secure in-door parcel receiving apparatus comprising:

an interior frame;

an exterior frame;

a closure;

a hinge;

a locking mechanism;

the interior frame and the exterior frame each comprising a lateral body and an aperture;

the locking mechanism comprising a user interface;

the lateral body delineating the aperture for each of the interior frame and the exterior frame, wherein the aperture centrally traverses through the lateral body for each of the interior frame and the exterior frame;

the interior frame and the exterior frame being connected adjacent to each other, wherein the interior frame is configured to be mounted to an aperture traversing through a barrier adjacent to an interior side of the barrier, and wherein the exterior frame is configured to be mounted to the interior frame adjacent to an exterior side of the barrier;

the aperture of the interior frame and the aperture of the exterior frame being positioned concentrically with each other;

the closure being hingedly connected to the exterior frame through the hinge;

the closure being releasably fastened in a closed position over the aperture of the exterior frame through the locking mechanism, wherein the aperture of the exterior frame is occluded by the closure in the closed position;

the user interface being operatively connected to the locking mechanism, wherein the user interface is configured to disengage the locking mechanism if a valid user input is received through the user interface;

the lateral body of the interior frame and the exterior frame each comprising a frame attachment body and a flange;

the frame attachment body and the flange being perimetrically and perpendicularly connected to each other for each of the interior frame and the exterior frame;

the frame attachment body of the exterior frame being positioned perimetrically adjacent to and within the frame attachment body of the interior frame;

a plurality of frame fasteners;

the frame attachment body of the interior frame and the frame attachment body of the exterior frame each comprising a plurality of frame mounting holes;

the plurality of frame mounting holes of the interior frame being aligned with the plurality of frame mounting holes of the exterior frame; and each of the plurality of frame fasteners traversing through one of the plurality of frame mounting holes of the interior frame and one of the frame mounting holes of the exterior frame, wherein the frame attachment body of the exterior frame is mounted to the frame attachment body of the interior frame through the plurality of frame fasteners.

2. The secure in-door parcel receiving apparatus as claimed in claim 1, wherein the barrier is a garage door.

3. The secure in-door parcel receiving apparatus as claimed in claim 1 comprising:

the interior frame and the exterior frame each comprising a top side, a bottom side, a first lateral side, and a second lateral side, wherein the interior frame and the exterior frame have rectangular geometry; and the top side and the bottom side being terminally connected between the first lateral side and the second lateral side and positioned opposite each other along the first lateral side and the second lateral side.

4. The secure in-door parcel receiving apparatus as claimed in claim 1 comprising:

the flange of the interior frame being configured to be connected around the aperture of the barrier.

5. The secure in-door parcel receiving apparatus as claimed in claim 1 comprising:

the flange of the interior frame comprising a plurality of barrier mounting holes traversing therethrough; and wherein the flange of the interior frame is configured to be mounted to the barrier through the plurality of barrier mounting holes and a plurality of barrier mounting fasteners.

6. The secure in-door parcel receiving apparatus as claimed in claim 1 comprising:

the hinge being a spring-loaded hinge configured to support the closure in a partially open position, wherein the closure is positioned at a desired angle to the exterior frame in the partially open position.

7. The secure in-door parcel receiving apparatus as claimed in claim 1 comprising:

the hinge comprising a rod;

the rod being laterally connected between a first lateral side and a second lateral side of the external frame adjacent to an upper side of the external frame; and the closure being terminally and rotatably connected to the rod.

8. The secure in-door parcel receiving apparatus as claimed in claim 1 comprising:

the hinge comprising a plurality of springs; and each of the plurality of springs being operatively connected between the exterior frame and the closure, wherein the plurality of springs is configured to support the closure in a partially open position, wherein the closure is positioned at a desired angle to the exterior frame in the partially open position.

9. The secure in-door parcel receiving apparatus as claimed in claim 8 comprising:

each of the plurality of springs positioned around a rod of the hinge.

10. The secure in-door parcel receiving apparatus as claimed in claim 1 comprising:

the closure comprising a proximal end and a distal end;

the proximal end of the closure being rotatably connected to the external frame through the hinge;

the locking mechanism being connected to the distal end of the closure; and the locking mechanism being configured to releasably engaged with a bottom end of the external frame when the closure is in the closed position.

11. The secure in-door parcel receiving apparatus as claimed in claim 1 comprising:

the user interface of the locking mechanism comprising a combination lock.

12. The secure in-door parcel receiving apparatus as claimed in claim 1 comprising:

the user interface of the locking mechanism comprising an electronic keypad.

* * * * *